US006472830B2

(12) United States Patent
Ito et al.

(10) Patent No.: US 6,472,830 B2
(45) Date of Patent: Oct. 29, 2002

(54) DISCHARGE LAMP LIGHTING CIRCUIT

(75) Inventors: Masayasu Ito, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/764,248

(22) Filed: Jan. 17, 2001

(65) Prior Publication Data

US 2001/0033140 A1 Oct. 25, 2001

(30) Foreign Application Priority Data

Jan. 17, 2000 (JP) ..... P. 2000-007622

(51) Int. Cl.[7] ..... G05F 1/00

(52) U.S. Cl. ..... 315/308; 315/224; 315/225; 315/DIG. 2; 315/DIG. 5; 315/DIG. 7

(58) Field of Search ..... 315/308, 310, 315/307, 291, 209 R, 224, 225, 226, 209 T, 362, DIG. 5, DIG. 7, DIG. 2

(56) References Cited

U.S. PATENT DOCUMENTS

| | | | | |
|---|---|---|---|---|
| 3,889,153 A | * | 6/1975 | Pierce | 315/101 |
| 5,486,740 A | | 1/1996 | Yamashita et al. | 315/308 |
| 5,498,933 A | * | 3/1996 | Nakamura | 315/205 |
| 5,705,898 A | | 1/1998 | Yamashita et al. | 315/308 |
| 6,034,487 A | | 3/2000 | Yamashita et al. | 315/244 |
| 6,034,490 A | * | 3/2000 | Yamashita et al. | 315/209 R |

* cited by examiner

*Primary Examiner*—Don Wong
*Assistant Examiner*—Thuy Vinh Tran
(74) *Attorney, Agent, or Firm*—Fish & Richardson P.C.

(57) ABSTRACT

A discharge lamp lighting circuit is provided with a DC power source circuit, a DC-AC conversion circuit, and start circuits. A primary circuit of a transformer in each start circuit has a capacitor and a switch element. When the voltage across the capacitor exceeds a threshold value, or when the switch element has electrical continuity, a high voltage is supplied separately to the discharge lamps from the primary coil through the secondary coil. A common voltage supply circuit supplies the voltage to the primary circuit of each start circuit from the DC power source circuit or the DC-AC conversion circuit.

9 Claims, 7 Drawing Sheets

DISCHARGE LAMP LIGHTING CIRCUIT

BACKGROUND OF THE INVENTION

1. Field of the Invention

The present invention relates to a lighting circuit for supplying a voltage to a start circuit that generates a high voltage signal to a discharge lamp.

2. Description of the Related Art

For a lighting circuit of a discharge lamp such as a metal halide lamp or the like, use of a DC power source circuit, a DC-AC conversion circuit, and a start circuit (so-called starter circuit) is well known.

For example, a DC-DC converter is used in the DC power source circuit. A full bridge type circuit comprising two pairs of semiconductor switch elements or switching elements for conducting switch control is used as a DC-AC conversion circuit and a driver circuit for controlling the switching elements. After an output voltage of the DC-DC converter is converted into a rectangular wave-shaped voltage, this voltage is supplied to the discharge lamp.

If the lighting circuit is separately provided for each of a plurality of discharge lamps, the number of parts and costs become a concern. Therefore, common circuits may be used as the DC power source circuit and the DC-AC conversion circuit.

The voltage supplied to the start circuit is generated according to the output of the DC power source circuit or the DC-AC conversion circuit. However, if the voltage supply circuit for each start circuit is separately provided, the cost and the size of the apparatus may increase.

Accordingly, the present invention provides a lighting circuit for a plurality of discharge lamps where a common circuit for supplying a voltage to the start circuit is provided for each of the discharge lamps. Thus, reduction in the cost and the size of the apparatus can be achieved.

SUMMARY OF THE INVENTION

The present invention relates to a discharge lamp lighting circuit. A DC power source circuit is provided to output a DC voltage and a DC-AC conversion circuit converts the output voltage of the DC power source circuit into an AC voltage. The AC voltage is supplied to a discharge lamp. Start circuits provided for each of the discharge lamps to respectively generate a starting high voltage signal to a plurality of discharge lamps.

The present invention comprises the structures shown as (A) to (E):

(A) The DC power source circuit outputs a bipolar voltage of positive and negative polarity to the ground potential.

(B) The DC-AC conversion circuit is provided with a plurality of switch elements to switch the output voltage of each polarity from the DC power source circuit and to send the switched voltage to each discharge lamp. It also has a drive circuit to conduct the switching control of the elements.

(C) Each start circuit has a transformer including a magnetic substance and a primary coil and a secondary coil. A primary circuit of the transformer has a serial circuit of a capacitor and a switch element, and the serial circuit is connected in parallel to the primary coil of the transformer.

(D) When the voltage across both terminals of the capacitor exceeds a threshold value according to the charge accumulation of the capacitor in the primary circuit of the transformer, or when the switch element of (C) achieves electrical continuity, the starting high voltage signal is applied to the discharge lamp from the primary coil through the secondary coil.

(E) A common voltage supply circuit is provided to supply the voltage from the DC power source circuit or the DC-AC conversion circuit to the primary circuit to charge the capacitor of the primary circuit of each start circuit.

According to the present invention, the voltage supply circuit for supplying voltages to the capacitor of the primary circuit of a transformer comprising the start circuit, which is provided to each discharge lamp, is commonly provided to each start circuit. Thus, reduction in the cost and the size of the apparatus can be realized.

DETAILED DESCRIPTION OF THE INVENTION

Figure 1:
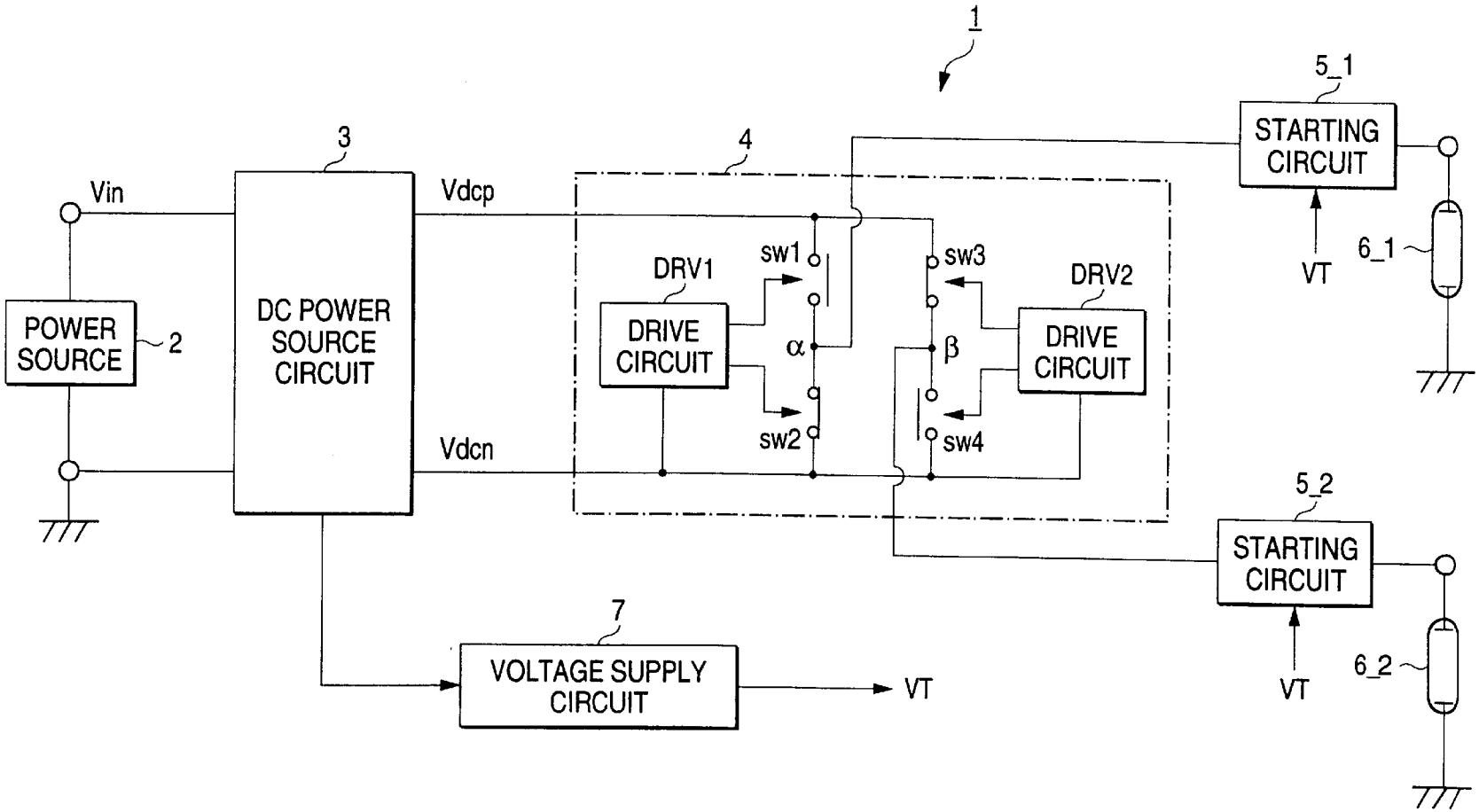
FIG. 1 is an example of a discharge lamp lighting circuit according to the present invention.

FIG. 1 is an example of a discharge lamp lighting circuit according to the present invention. The circuit structure shows a power feeding system excluding a control system for two discharge lamps.

A discharge lamp lighting circuit 1 is provided with a power source 2, a DC power source circuit 3, a DC-AC conversion circuit 4, and start circuits 5-1 and 5-2.

The DC power source circuit 3 receives a DC input voltage (Vin) from the power source 2 and outputs the desired DC voltage. The output voltage is variably controlled according to the control signal from a control circuit, which is not shown. In this DC power source circuit 3, a DC-DC converter (e.g chopper type or fly-back type) having the structure of a switching regulator is provided. It has circuit components for generating a bipolar voltage of positive and negative polarity in reference to the ground potential.

FIG. 2 shows an example of the DC power supply circuit 3.

Figure 2A:
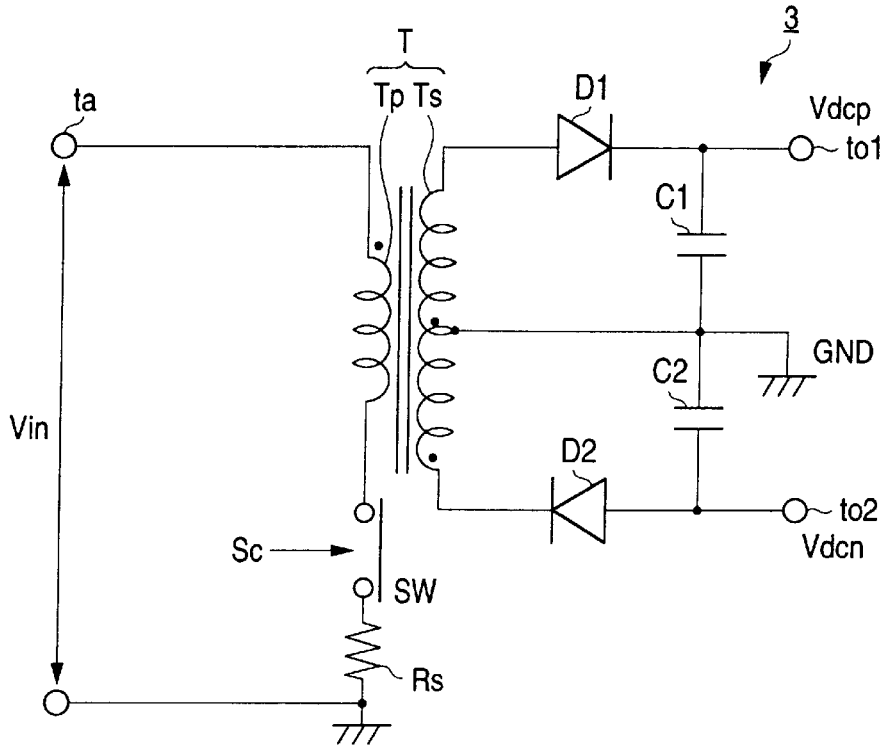
FIG. 2 is a an example of a DC power source circuit.

In FIG. 2A, one end of a primary coil Tp of a transformer T is connected to a DC input terminal ta to which a voltage Vin is applied. The other end of the primary coil Tp is electrically grounded through a semiconductor switch element SW (e.g. a field effect transistor (FET)) and a resistor Rs for current detection. A signal Sc from the control circuit, not shown, is supplied to a control terminal (if FET, the gate) of the semiconductor switch element SW to control switching.

In the secondary coil Ts of the transformer T, one end is connected to the anode of a diode D1. The cathode of the diode D1 is electrically grounded through a capacitor C1. The terminal voltage of the capacitor C1 becomes a positive output voltage Vdcp through a terminal to1. Further, the other end of the secondary coil Ts is connected to the cathode of a diode D2, and the anode of the diode D2 is electrically grounded through a capacitor C2, which is connected to a terminal to2. A negative output voltage Vdcn is obtained at this terminal.

Thus, the DC power source circuit 3 outputs the voltages Vdcp and Vdcn of positive and negative polarity, respectively, from two output terminals to1 and to2.

Amark"." on the transformer T shows a beginning of winding. For example, in the secondary coil Ts, the mark "." close to the diode D2 indicates where the winding starts. Another winding starts at an electrically grounded intermediate tap.

Figure 2B:
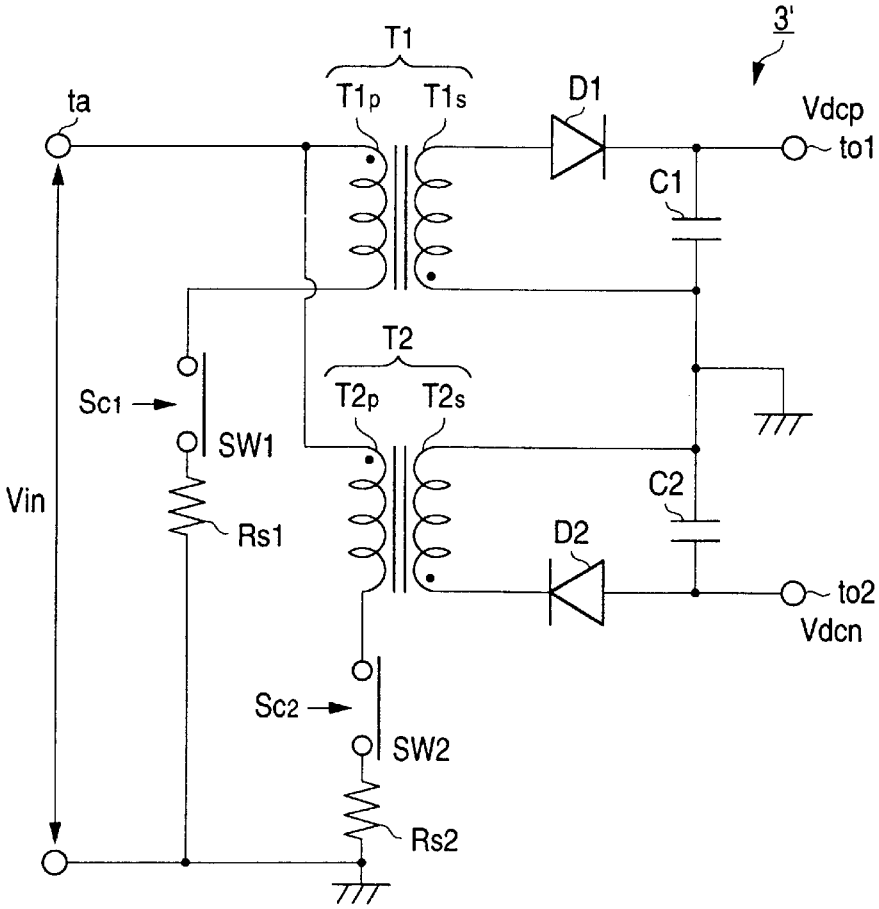

Further, in a DC power supply circuit 3' shown in FIG. 2B, a transformer T1 comprising a primary coil T1p and a secondary coil T1s, and a transformer T2 comprising a primary coil T2p and a secondary coil T2s are provided. Switch elements SW1, SW2 or the current detection resistances Rs1, Rs2 are respectively connected to the primary coils T1p, T2p of each transformer. When these switch elements SW1 and SW2 are respectively controlled to turn on/off by control signals Sc1 and Sc2, a secondary output maybe independently and variablely controlled. That is, by the on/off control of the switch element SW1, the current flowing through the primary coil T1p of the transformer T can be controlled, and the voltage vdcp is obtained at the output terminal tol through the diode D1 and the capacitor C1 from the secondary coil T1s. Similarly, by the on/off control of the switch element SW2, the current flowing through the primary coil T2p of the transformer T2 is controlled, and the voltage Vdcn is obtained at the output terminal to2 through the diode D2 and the capacitor C2 from the secondary coil T2s.

The DC power source circuit 3 is configured to have a plurality of switch elements to switch the output voltage of each polarity and to send it to each discharge lamp. The DC-AC conversion circuit 4 is provided with a drive circuit to conduct the switching control of the element. For example, the full-bridge type circuit structure comprising 4 switch elements SW1, SW2, SW3, and SW4, which may be semiconductor switching elements, is provided.

The switch elements SW1 and SW2 are paired by being serially connected to each other. One end of the SW1 is connected to the positive polarity output terminal of the DC power source circuit 3, and the other end is connected to the negative polarity output terminal of the DC power source circuit 3 through the switch element SW2. A first discharge lamp 6-1 is connected to a connection point a of both of the switch elements through the start circuit 5-1 (the inductive load thereof).

The switch elements SW3 and SW4 are paired by being serially connected to each other. One end of the SW3 is connected to the positive polarity output terminal of the DC power source circuit 3, and the other end is connected to the negative polarity output terminal of the DC power source circuit 3 through the switch element SW4. The second discharge lamp 6-2 is connected to the connection point β of both of the switch elements through the start circuit 5-2 (the inductive load thereof).

For each discharge lamp, the terminals not connected to the connection point α or β are electrically grounded as shown in the drawing or electrically grounded respectively through the current detection resistance.

An IC (integrated circuit) for a half bridge driver is used in drive circuits DRV1 and DRV2. The drive circuit DRV1 conducts on/off control of the switch elements SW1 and SW2, and the other drive circuit DRV2 conducts on/off control of the switch elements SW3 and SW4. When the switch element SW1 is turned on and the switch element SW2 is turned off by the drive circuit DRV1, the switch element SW3 is turned off and the switch element SW4 is turned on by the drive circuit DRV2. Further, when the switch element SW1 is turned off and the switch element SW2 is turned on by the drive circuit DRV1, the switch element SW3 is turned on and the switch element SW4 is turned off by the drive circuit DRV2. In this manner, the switch elements SW1 and SW4 are regulated to have one status, and the switch elements SW2 and SW3 are regulated to have another. The status of one pair of switches are reciprocally alternated from that of the other.

Accordingly, by the on/off operation of the two pairs of switch elements, a positive voltage can be supplied to the first discharge lamp 6-1, and a negative voltage can be supplied to the second discharge lamp 6-2. Alternatively, a negative voltage can be supplied to the first discharge lamp 6-1, and a positive voltage can be supplied to the second discharge lamp 6-2.

The start circuits 5-1 and 5-2 are provided respectively to each of the discharge lamps 6-1 and 6-2. During the initial lighting period of the discharge lamp, a high voltage signal (starting pulse) is generated. The signal is superimposed on the AC voltage (rectangular wave voltage) originating from the DC-AC conversion circuit 4, and the resultant signal is applied to each of the discharge lamps to activate the lamps.

The voltage supply circuit 7 is commonly provided to each of the start circuits. The circuit 7 supplies a voltage (in FIG. 1, VT) necessary to generate the above high voltage signal for activation to each start circuit according to the voltage from the DC power source circuit 3 or the DC-AC conversion circuit 4.

Figure 3:
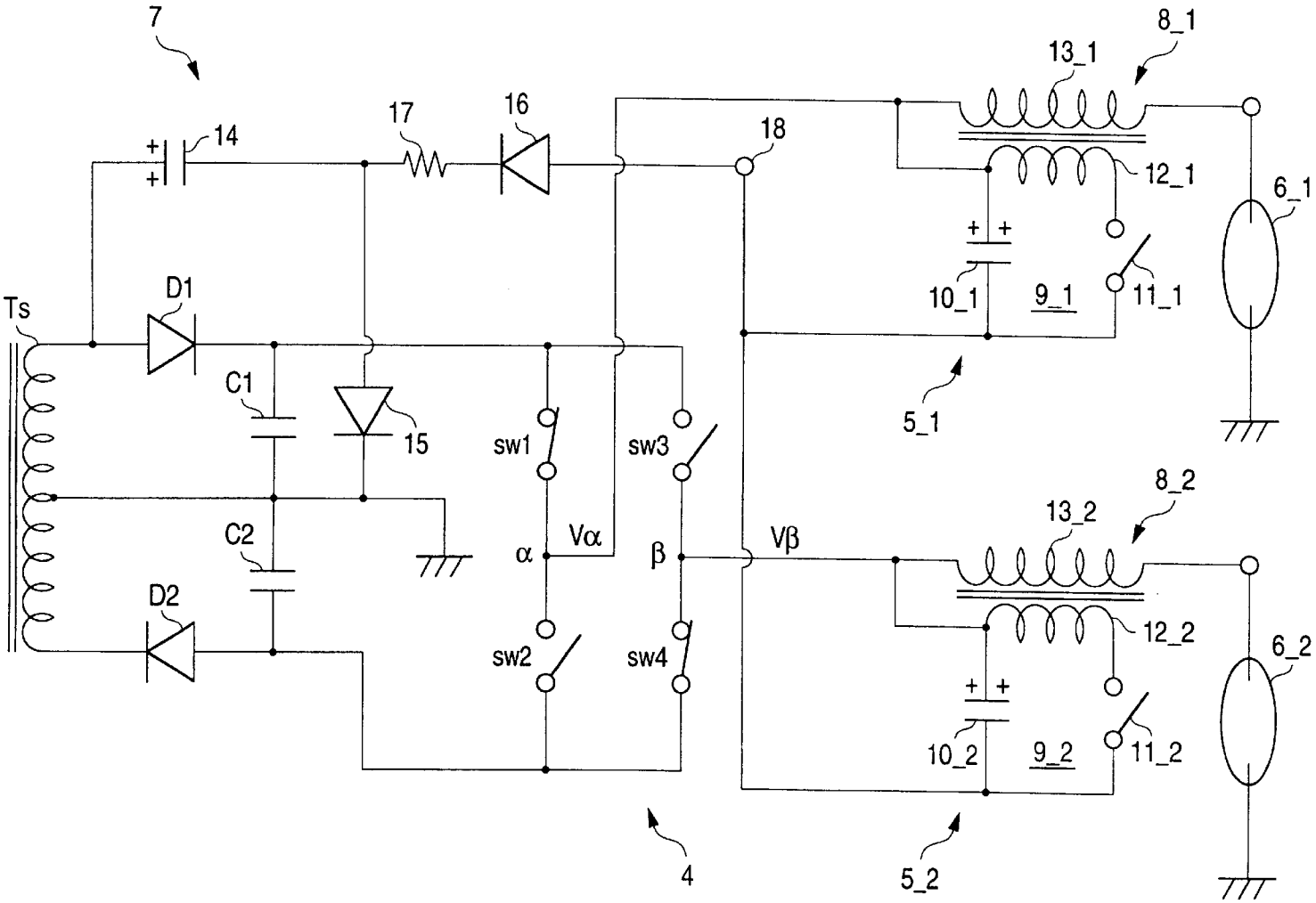
FIG. 3 is an example of a voltage supply circuit.

FIG. 3 shows an example of a secondary side of the converter transformer comprising the DC power source circuit and other circuits beyond. The same DC power source circuit as shown in FIG. 2 is used. However, in the present example, the positive voltage of the bipolar output from the DC power source circuit is used, and the supply voltage to the primary circuit of each start circuit is obtained.

Because all the start circuits have the same structure, only the start circuit 5-1 will be described below.

The start circuit 5-1 has a magnetic substance (core) and a transformer 8-1 including a primary coil and a secondary coil. A primary circuit 9-1 of the transformer 8-1 has a serial circuit comprising a capacitor 10-1 and a switch element 11-1 such as a self-yielding type switch element or a thyristor controlled by an outside signal. The serial circuit is connected in parallel with the primary coil 12-1.

One end of the secondary coil 13-1 is connected to the connection point α of the switch elements SW1 and SW2 in the DC-AC conversion circuit 4, and the other end is connected to the discharge lamp 6-1. The primary coil 12-1 has its one end connected to the terminal of the secondary coil 13-1 at the reverse side to the discharge lamp 6-1 and also connected to the capacitor 10-1. The other end is connected to the switch element 11-1.

The voltage from a voltage supply circuit 7 is supplied to the connection point of the capacitor 10-1 and switch element 11-1.

The starting high voltage signal is applied to the discharge lamp 6-1 from the primary coil 12-1 through the secondary coil 13-1 when the voltage across both terminals of the capacitor exceeds a threshold value corresponding to the electric charge accumulation of the capacitor 10-1 in the primary circuit 9-1, or when the switch element 11-1 has continuity after the capacitor exceeds the threshold value.

In FIG. 3 of the start circuit 5-2, the common end of the secondary coil 13-2 and the primary coil 12-2 of the transformer 8-2 is connected to the connection point 0 of the switch elements SW3 and SW4 in the DC AC conversion circuit 4.

The voltage supply circuit 7 is provided for the output of the DC power source circuit (in this case, the positive polarity output) in the present example and comprises a capacitor 14, diodes 15, 16, and a resistor 17.

The capacitor 14 is provided in parallel to the rectifying diode D1 connected to one end of the secondary coil Ts. The connection point of the resistor 17 connected to the capacitor 14 is electrically grounded through the diode 15. The other end is connected to the terminal 18 through the diode 16, and through the terminal, connected to the primary circuit (at the connection point of the capacitor and the switch element in the circuit) of each start circuit. That is, one end of the capacitor 14 is connected to the anode of the diode D1, and the other end is connected to the resistor 17 and the anode of the diode 15, and the cathode of the diode 15 is electrically grounded. The side of the resistor 17 opposite to the capacitor 14 is connected to the cathode of the diode 16, and the anode of the diode 16 is connected to the terminal 18.

Each of four switch elements (SW1 to SW4) constituting the DC -AC conversion circuit 4 is switch-controlled so that the output voltage Vβ from the connection point β and the output voltage Vβ from the connection point β have reverse polarity.

When the discharge lamp 6-1 is turned on, the polarity of Vα is defined as positive, and the polarity of Vβ is defined as negative.

Higher the high voltage temporarily sent from the DC power source circuit (open voltage OCV), easier it is to turn the discharge lamp on. For example, assume that the positive secondary voltage of the converter transformer is rectified and smoothed as OCVP, and the negative secondary voltage of the converter transformer is rectified and smoothed as OCVn. When the switch elements SW1, SW4 are switched on, and the switch elements SW2, SW3 are witched off, the voltage of OCVp is obtained as Vα, and the voltage of OCVn is obtained as Vβ.

If the self-yielding element is used as a switch element comprising the primary circuit for each start circuit, a higher voltage is necessary for the voltage across both terminals of the capacitor 10-1 of the start circuit 5-1. The breakdown voltage is written as VS.

If the voltage across both terminals is higher than VS, this maybe satisfactory because the voltage of OCVp is applied to one end of the capacitor 10-1 and the negative voltage is applied to the other end of the capacitor from the voltage supply circuit 7.

In FIG. 3, on the anode of the rectifying diode D1, the alternating voltage, OCVp lower than 0 V, is repeated at a switching frequency of the converter by the half-wave rectification action. When the voltage becomes OCVp, the current flows to the capacitor 14 through the diode 15 and the capacitor is charged. When the voltage (anode voltage) is smaller than 0 V, the potential of the connection point of the capacitor 14 and the diode 15 is temporarily lowered (in the drawing, the polarity of the capacitor 14 is shown by sign +). The current path is from the output terminal (α) of the DC-AC conversion circuit 4 to the capacitor 10-1 of the start circuit 5-1 to the diode 16 to the resistor 17 and then to the capacitor 14. The current further flows to the secondary coil Ts of the transformer and then to the smoothing capacitor. Thereby, the electrical charge of the capacitor 10-1 of the is transferred to the capacitor 14. Accordingly, when such cycle is repeated several times (charging time depends on the ratio of electrostatic capacity of each capacitance, or the resistance value of the resistor 17), the voltage of −OCVp is obtained as an output of the voltage supply circuit 7. As a result, a voltage value sufficient for the switch element 11-1 to have continuity is obtained because the voltage of max. 2 ×OCVp (when switch element has no continuity) is obtained across the capacitance 10-1 of the primary circuit 9-1 when the switch element 11-1 is selected. Thus, the relationship of VS<2×OCVp is attained.

In contrast, when the switch element 11-2 is selected to satisfy the relationship of VS<2×OCVp−OCVn, the capacitor 10-2 of the start circuit 5-2 is charged by the voltage OCVp—OCVn. Thus, the self-yielding of the element is not generated.

Further, to turn the discharge lamp 6-2 on, the polarity of Vβ is made positive and the polarity of Vα is made negative. Therefore, the role of the voltage supply circuit to the primary circuit of each start circuit is reversed. The maximum voltage of 2×OCVn is obtained across the capacitor 10-2.

When one side of the discharge lamp 8 (for example, 6-1) is already on, and when the other discharge lamp 6-2 is turned on, the polarity of the output voltage of the DC-AC conversion circuit to the discharge lamp 6-2 may be made positive. The polarity of the output voltage of the DC-AC conversion circuit to the discharge lamp 6-1 may be made negative. However, because the negative output voltage can be approximately equal to 0 V for the self-yielding voltage VS of the switch element, the relationship of 2×OCVp>VS>OCVp can be attained when the switch element is selected.

The resistor 17 shown in FIG. 3 is provided to restrict the current flow to the diode 16 and to adjust the time necessary for the capacitor 10-1 (or 10-2) of the primary circuit to become fully charged. For the same purpose, for example, a resistor maybe connected serially to the diode 15 or added to the capacitor 14. These resistors optionally may not be provided.

Figure 4:
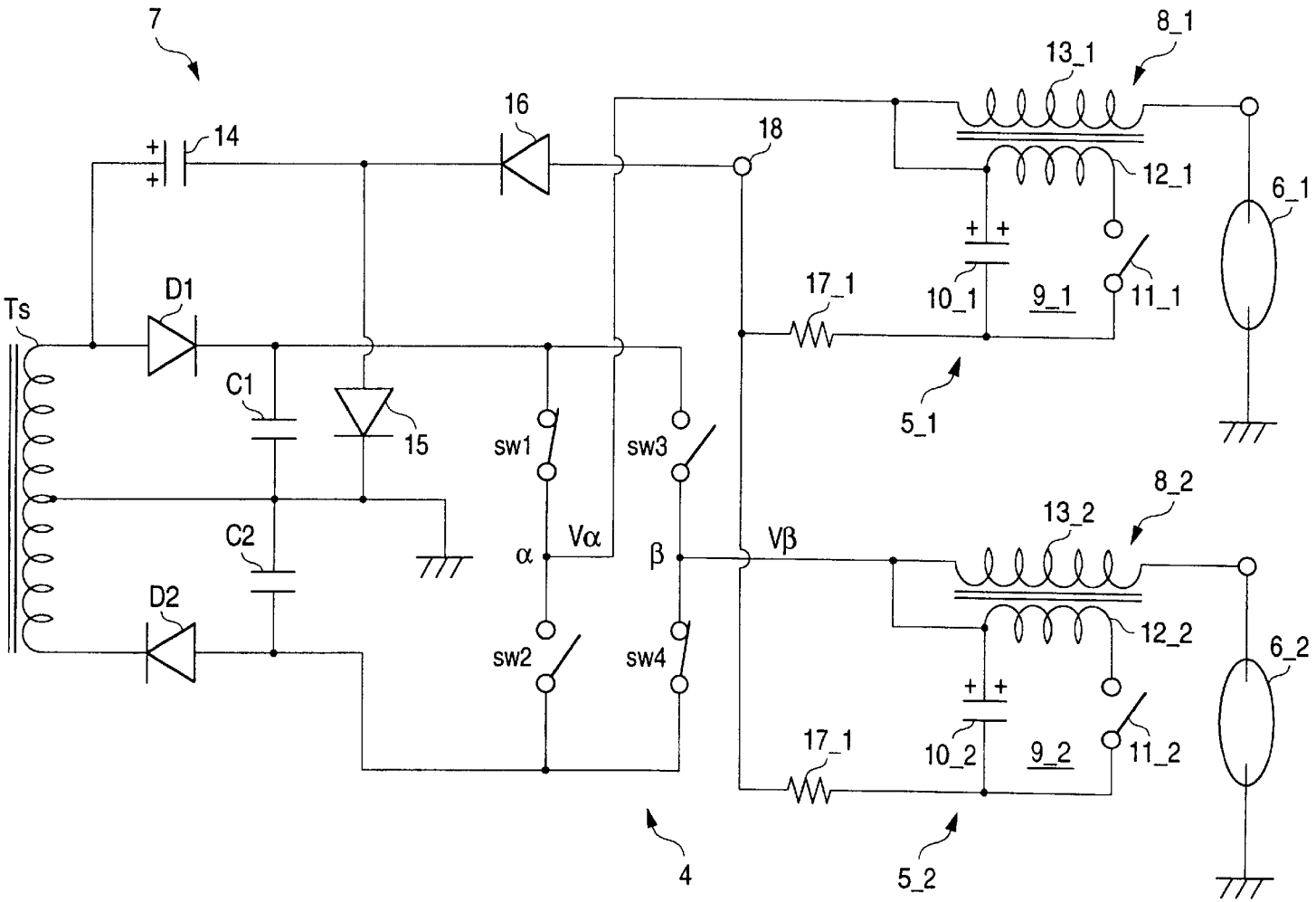
FIG. 4 is a modified example of the voltage supply circuit.
Figure 5:
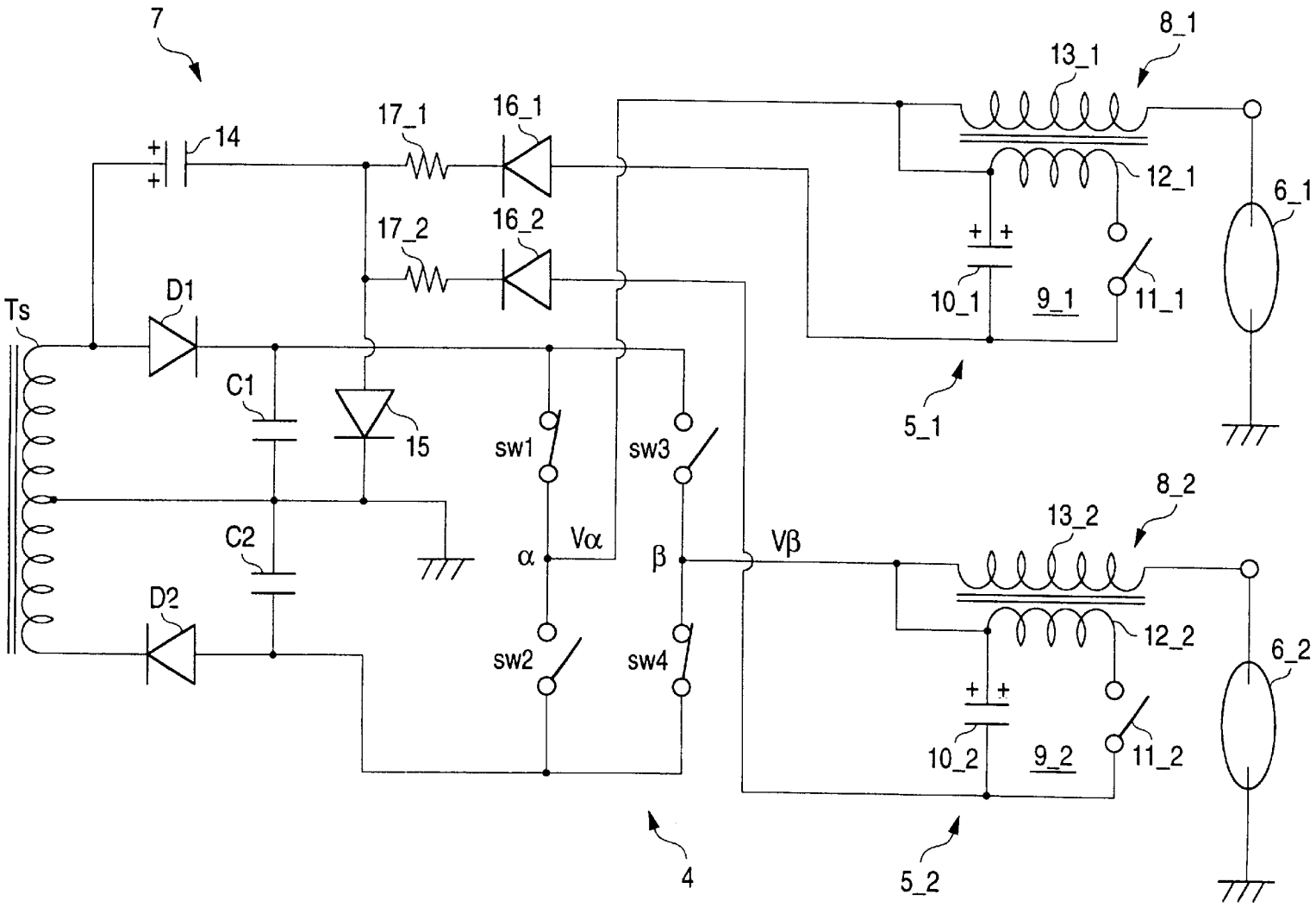
FIG. 5 is another modified example of the voltage supply circuit.

Further, although the resistor 17 is on the cathode side of the diode 16 in FIG. 3, it is not necessarily limited to that position. For example, as shown in FIG. 4, the cathode of the diode 16 is connected to the capacitor 14 and the resistors 17-1, 17-2 are respectively placed on the anode side of the diode 16. Voltages may be supplied to the primary circuit of each start circuit through each resistor. One end of each of resistors 17-1, 17-2 is connected to the anode of the diode 16, and the other ends are respectively connected the connection point of the capacitor and the switch element of each primary circuit. In FIG. 5, the serial circuit of the resistor 17-1 and the diode 16-1, and the serial circuit of the resistor 17-2 and the diode 16-2 are provided in parallel with each other. The anode of each diode is respectively connected to the primary circuit of each start circuit. The anode of the diode 16-1 is connected to the connection point of the capacitor 10-1 and the switch element 11-1, and the cathode of the diode 16-1 is connected to the capacitor 14 or the diode 15 through the resistor 17-1. The anode of the diode 16-2 is connected to the connection point of the capacitor 10-2 and the switch element 11-2, and the cathode of the diode 16-2 is connected to the capacitor 14 or the diode 15 through the resistor 17-2.

In the transformers 8-1 or 8-2, the connection terminal of the secondary coil and the primary coil is connected to one side of the output terminal of the DC-AC conversion circuit 4. However, the circuit configuration is not limited to this. Any appropriate closed circuit (primary circuit) comprising a primary coil of a transformer, a capacitor, and a switch element can be connected to the output terminal of the DC-AC conversion circuit as long as a voltage supplied to the primary circuit can provide sufficient voltage across the capacitor for the switch element to achieve continuity.

Figure 6:
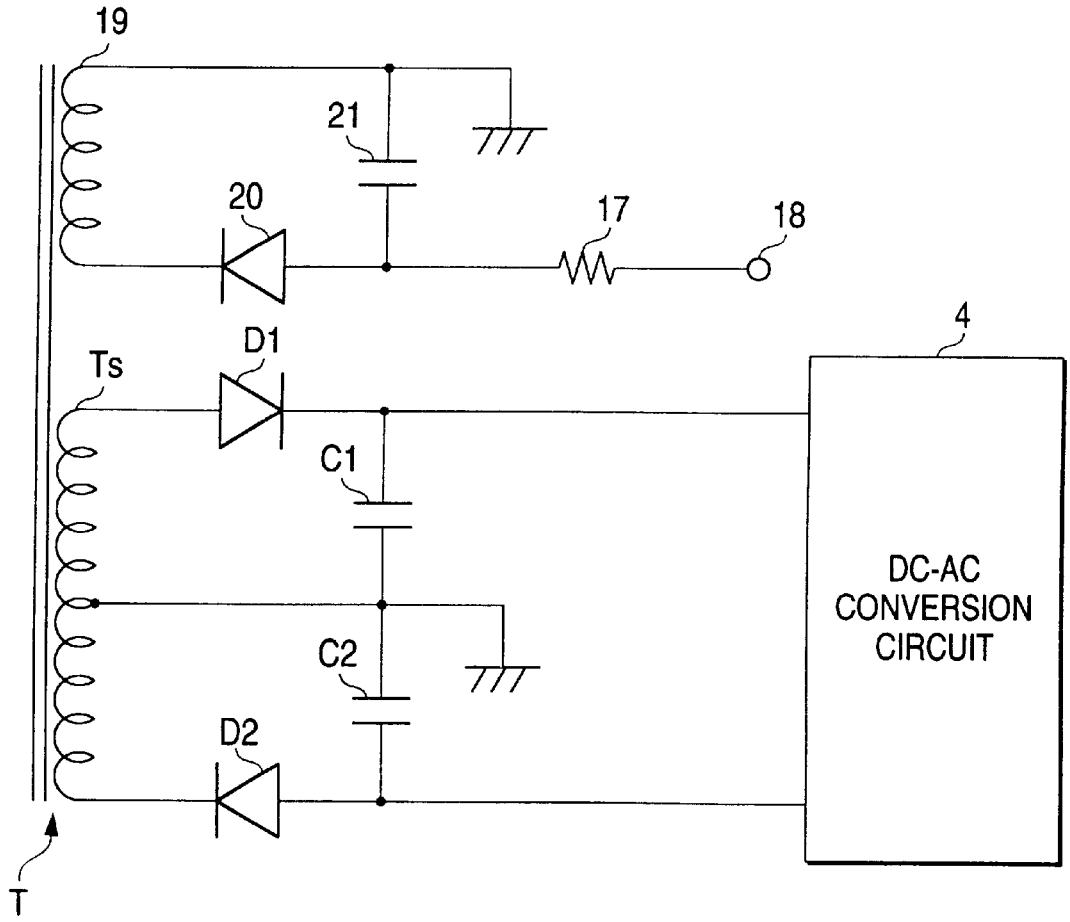
FIG. 6 is an example of a secondary coil provided at the secondary side of a transformer.

In FIG. 6, the secondary coil 19 other than the secondary coil Ts is provided to the secondary side of the converter transformer T. The diode 20 and the capacitor 21 are provided. The negative voltage is generated and supplied to the primary circuit of each start circuit.

In this example, one end of the secondary coil 19 is connected to the cathode of the diode 20, and the anode of the diode is connected to the voltage supply terminal 18 through the resistor 17. One end of the capacitor 21 is connected to the anode of the diode 20, and the other end is electrically grounded. The negative voltage rectified and smoothed after being generated in the secondary coil 19 is supplied to the primary circuit of each start circuit from the voltage supply terminal 18. To make the absolute value of the secondary voltage the same as the secondary voltage in the secondary coil, the winding ratio may be the same value for both secondary coils. The absolute value of the negative voltage can be adjusted by changing the winding ratio.

The voltage supplied to the primary circuit is obtained from the DC power source circuit. However, the voltage can be obtained from the output of the DC-AC conversion circuit For example, the serial circuit of the diode and the capacitor can be inserted at a point between output terminals of the DC-AC conversion circuit (between the connection points $\alpha$ and $\beta$), and the voltage obtained from the connection point of the diode and the capacitor can be supplied to the primary circuit of each start circuit through the resistor, or a similar structure.

Figure 7:
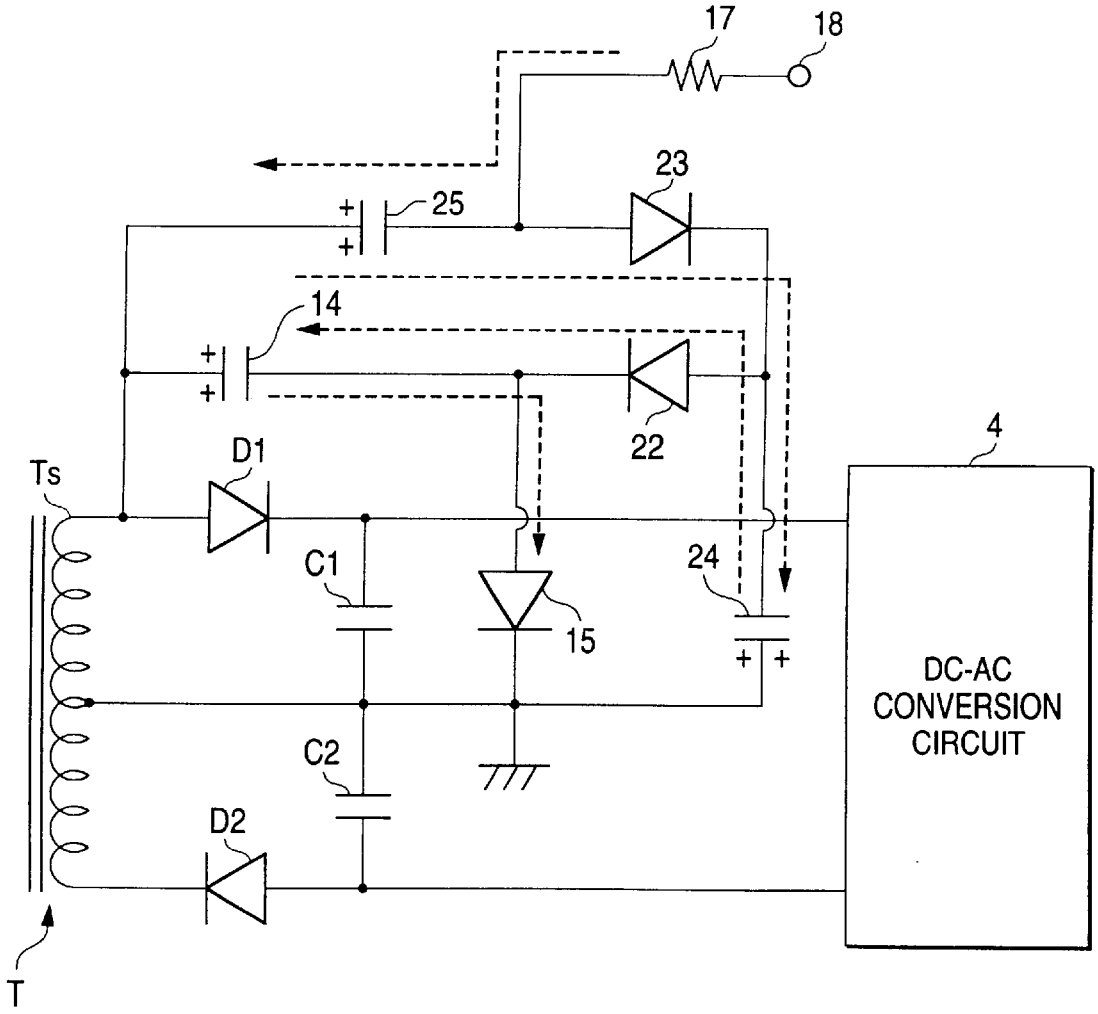
FIG. 7 is an example of a voltage supply circuit.

Further, when an element having a high self-yielding voltage is to be used as a switch element, for example, a circuit structure shown in FIG. 7 can be used.

In FIG. 7, a circuit section (voltage supply circuit) configured between the secondary circuit of the converter transformer T comprising the DC power source circuit and the DC-AC conversion circuit 4 is shown. The circuit comprises a plurality of diodes 15, 22, 23 and capacitors 14, 24, and 25.

The relationship of the rectifying diodes (D1, D2) and the smoothing capacitors (C1, C2) for the secondary coil Ts of the converter transformer T is the same as the example shown in FIG. 3.

One end of the capacitor 14 provided in parallel to the diode D1 is connected to the anode of the diode D1, and the other end is connected to the anode of the diode 15, and the cathode of the diode 15 is electrically grounded.

Further, the cathode of the diode 22 is connected to the connection point of the capacitor 14 and the diode 15, and the anode is electrically grounded through the capacitor 24, and connected to the cathode of the diode 23.

The anode of the diode 23 is connected to the anode of the diode D1 through the capacitor 25, and connected to the voltage supply terminal 18 through the resistor 17, and the negative voltage obtained from the voltage supply terminal 18 is supplied to the primary circuit of each start circuit.

The direction of the current at the time of the electric charge movement is shown by a plurality of arrows shown by broken lines. Before the discharge lamp is activated, assume that the voltage OCVp in the secondary coil is 350 V. As a current flows, the anode voltage of the diode D1 becomes 350 V, and the current paths are shown by an arrow mark from the capacitor 14 towards the forward direction of the diode 15 and by an arrow mark from the capacitor 25 toward the forward direction of the diode 23. When the anode voltage of the diode D1 is lower than 0 V, the current paths are shown by an arrow mark from the capacitor 24 toward the forward direction of the diode 22 and by an arrow mark from the resistor 17 to the capacitor 25.

As a result of such electrical charge movement, the supply voltage of $-350\times2=-700$ V can be obtained. A voltage three times the OCVp can be supplied across the capacitor of the primary circuit. Accordingly, when a self-yielding type element is used as a switch element, an element having the value of its self-yielding voltage not larger than 3×OCVp but larger than 2×OCVp may be used. In terms of the costs and size of the start circuit, it is advantageous to have the primary voltage higher, and the fluctuation of the self-yielding voltage of the switch element should be considered.

When the number of stages of the circuit using a diode and a capacitor is increased, a negative voltage of larger absolute value can be supplied.

With respect to the positive and negative bipolar output from the DC power source circuit 3, if the negative voltage is used, and the supply voltage to the primary circuit of each start circuit is used, the basic concept is the same when the direction of the diode and the direction of the electric charge movement to the capacitor are reversed.

For example, in FIG. 3, when the direction of all the diodes (D1, D2, 15, 16) is reversed, the positive polarity voltage obtained from the negative polarity output voltage can be supplied to the primary circuit of each start circuit. Accordingly, when the self-yielding voltage of each switch element is assumed to be 600 V, the voltage of +350 V is obtained in the capacitor of the voltage supply circuit 7. A maximum of 700 V (=2×OCVn) is obtained across the capacitor of the primary circuit. This voltage is enough to make the switch element have continuity. The polarity of the output voltage of the DC-AC conversion circuit is negative.

The voltage supplied to the primary circuit can be obtained from the output of the DC-AC conversion circuit. Or, as shown in FIG. 6, the secondary coil is provided to the converter transformer to supply the voltage to the primary circuit. Or, as shown in FIG. 7, a voltage can be supplied when the self-yielding voltage is high. Here, it is necessary that the direction of the diode or the direction of the electric charge movement be reversed.

Assume that a first discharge lamp is turned on, and a second discharge lamp is not turned on. When a starting high voltage signal is generated by the start circuit before the first discharge lamp is activated, the polarity of the voltage sent from a DC-AC conversion circuit to the discharge lamp is reversed from the polarity of the voltage sent from a DC-AC conversion circuit to the second discharge lamp.

For example, in FIG. 3, when the first discharge lamp 6-1 is turned on and a starting high voltage signal is generated, the polarity of the voltage ($V\alpha$) sent from the DC-AC conversion circuit 4 to the discharge lamp is made positive. The polarity of the voltage ($V\beta$) sent from the DC-AC conversion circuit 4 to the inactivate second discharge lamp 6-2 is made negative. Since the negative and positive voltages from the voltage supply circuit are supplied to the primary circuit of each start circuit, the regulation of the polarity of the output voltages ($V\alpha$, $V\beta$) are correspondingly reversed.

Accordingly, a desired discharge lamp is selected, and the starting high voltage is applied to the discharge lamp and started.

The potential of the capacitor of the primary circuit is obtained by applying a positive or a negative voltage to one end of the capacitor, and grounding the other. However, a following disadvantage is generated.

The voltage supplied to the primary circuit of the start circuit is obtained from a common voltage supply circuit. Because the same amount of electrical charge is provided to the capacitor of each primary circuit, the voltage across each capacitor (equals both terminal voltages of the switch element) is equal to each other. However, the self-yielding voltage of the switch element fluctuates. Because the switch having the lower self-yielding voltage achieves continuity earlier, the switches cannot be specified and operated. Further, even when the positive and negative voltages are supplied from the DC power source circuit to the respective capacitors, only one switch element connected to the negative pole or positive pole side is operated.

To avoid the above, the polarity should be regulated. When the polarity of the output voltage of the voltage supply circuit is negative (or positive), the capacitor is regulated to a potential of positive (or negative) polarity. To control the switch elements, it is sufficient to regulate only the polarity of the output voltage of the DC-AC conversion circuit in the no load condition before activating the discharge lamp. Circuits for exclusively and selectively starting the discharge lamp are not necessary.

According to the invention of the first embodiment, the transformer comprising the start circuit is provided separately for each of a plurality of discharge lamps, and the voltage supply circuit for charging the capacitor in the primary circuit of the transformer is commonly provided for each start circuit. Thus, the cost and the size of the apparatus can be reduced.

According to the invention of the second embodiment, the discharge lamp can be specified and selectively turned on. When one discharge lamp is to be turned on by applying a starting high voltage signal and the other not, one polarity of the voltage sent from the DC-AC conversion circuit is regulated to be reverse of the other.

The present invention claims priority from Japanese patent application serial no. H2000-007622, which is incorporated herein by this reference in its entirety.

Several embodiments of the invention have been described herein, but it should be understood that various additions and modifications could be made which fall within the scope of the following claims.

What is claimed is:

1. A discharge lamp lighting circuit comprising:

a DC power source circuit to output a bipolar voltage of positive polarity and negative polarity in reference to the ground potential;

a DC-AC conversion circuit for converting the DC voltage into an AC voltage and supplying the AC voltage to discharge lamps;

start circuits provided respectively for each discharge lamp to generate a high voltage signal for each discharge lamp; and a common voltage supply circuit to supply a voltage to each start circuit.

2. The discharge lamp lighting circuit according to claim 1, further comprising:

a plurality of switching elements in the DC-AC conversion circuit to switch the polarity of the voltage from the DC power source circuit and send the switched voltage to each discharge lamp; and a drive circuit to control the switching of the switch elements.

3. The discharge lamp lighting circuit according to claim 1, further comprising:

a transformer in each start circuit including a magnetic substance and a primary coil and a secondary coil; and a primary circuit of the transformer comprising a serial circuit of a capacitor and a switching element, the serial circuit being connected in parallel to the primary coil of the transformer.

4. The discharge lamp lighting circuit according to claim 3, wherein when the voltage across the capacitor exceeds a threshold value according to the property of the capacitor or when the switching element achieves electrical continuity, the high voltage signal is applied to each discharge lamp from the primary coil through the secondary coil.

5. The discharge lamp lighting circuit according to claim 3, wherein the common voltage supply circuit supplies a voltage from the DC power source circuit or the DC-AC conversion circuit to the primary circuit to charge the capacitor of the primary circuit of each start circuit.

6. The discharge lamp lighting circuit according to claim 1, wherein when the high voltage signal is generated by the start circuit before lighting, the polarity of the voltage from the DC-AC conversion circuit for the discharge lamp to be turned on is regulated to be the reverse of the polarity of the voltage from the DC-AC conversion circuit for the discharge lamp which is not to be turned on yet.

7. A discharge lamp lighting circuit comprising:

discharge lamps;

a DC power source circuit to output a bipolar voltage of positive polarity and negative polarity in reference to the ground potential;

a DC-AC conversion circuit to convert the DC voltage into an AC voltage, which is supplied to the discharge lamps;

a plurality of switching elements in the DC-AC conversion circuit to switch the polarity of the voltage from the DC power source circuit and send the switched voltage to each discharge lamp;

a drive circuit to control the switching of the switch elements;

start circuits provided respectively for the discharge lamps to generate a high voltage signal for each discharge lamp; and a common voltage supply circuit to supply a voltage to each start circuit;

a transformer in each start circuit including a magnetic substance and a primary coil and a secondary coil; and a primary circuit of the transformer comprising a serial circuit of a capacitor and a switching element, the serial circuit being connected in parallel to the primary coil of the transformer, wherein the common voltage supply circuit supplies a voltage from the DC power source circuit or the DC-AC conversion circuit to the primary circuit to charge the capacitor of the primary circuit of each start circuit.

8. The discharge lamp lighting circuit according to claim 7, wherein when the voltage across the capacitor exceeds a threshold value according to the property of the capacitor or when the switching element achieves electrical continuity the high voltage signal is applied to each discharge lamp from the primary coil through the secondary coils.

9. The discharge lamp lighting circuit according to claim 7, wherein when the high voltage signal is generated by the start circuit before lighting, the polarity of the voltage from the DC-AC conversion circuit for the discharge lamp to be turned on is regulated to be the reverse of the polarity of the voltage from the DC-AC conversion circuit for the discharge lamp which is not to be turned on yet.

* * * * *